United States Patent [19]

Cochran et al.

[11] Patent Number: 5,038,699

[45] Date of Patent: Aug. 13, 1991

[54] SAIL SHAPING ARRANGEMENT FOR A SAILING CRAFT

[76] Inventors: Steven M. Cochran, 2350 N. Woodward Ave., No. 5, Bloomfield, Mich. 48013; Mark J. Murphy, 1228 Oakwood Ct., Rochester, Mich. 48063

[21] Appl. No.: 498,639

[22] Filed: Mar. 26, 1990

[51] Int. Cl.[5] ..... B63H 9/04

[52] U.S. Cl. ..... 114/97; 114/98; 114/103

[58] Field of Search ..... 52/84; 441/65, 74; 114/43, 39.1, 39.2, 89, 97, 98, 102, 103, 108

[56] References Cited

U.S. PATENT DOCUMENTS

| | | | |
|---|---|---|---|
| 4,388,888 | 6/1983 | Gushurst | 114/103 |
| 4,593,638 | 6/1986 | Cochran | 114/90 |
| 4,706,541 | 11/1987 | Reynolds | 114/103 |
| 4,811,678 | 3/1989 | Sogell | 114/103 |
| 4,864,954 | 9/1989 | Farrar | 114/103 |
| 4,881,480 | 11/1989 | Stevenson | 114/103 |

FOREIGN PATENT DOCUMENTS

| | | | |
|---|---|---|---|
| 401658 | 9/1924 | Fed. Rep. of Germany | 114/97 |
| 2447833 | 10/1974 | Fed. Rep. of Germany | 114/97 |

*Primary Examiner*—Joseph F. Peters, Jr.
*Assistant Examiner*—Clifford T. Bartz
*Attorney, Agent, or Firm*—John R. Benefiel

[57] ABSTRACT

A sail shaping arrangement is disclosed for horizontal edges of a sail including a web formed along one side in a curved shape corresponding to the desired camber of the sail, the web attached to the sail edge to extend normally thereto. A diagonal batten stretches the web to establish a shaped edge to the sail. A skirt batten may also be used, as well as a tension cord along a straight, chordal side of the web.

10 Claims, 3 Drawing Sheets

SAIL SHAPING ARRANGEMENT FOR A SAILING CRAFT

This invention concerns a sail shaping arrangement for sailing craft, particularly advantageous for sailboards.

Sailboards include a hull shaped platform or board to which is pivotally attached a mast which extends generally upwardly from the board, but is raked substantially to the rear to enable resolution of the sail forces by a rider standing on the board and grasping a wish bone shaped boom attached to the mast at an intermediate height.

A triangularly shaped sail is surrounded by the boom and is secured to the mast along one side, with the angled outer side attached to the boom at the clew to enable the rider to tack by movement of the boom.

Sails are broad seamed, i.e., constructed of sewn together sections with curved sides, causing a three dimensional curvature or camber to be formed in the sail. This camber enables the sail to function as an air foil, generating lift to propel the craft forward.

At the lower or foot edge of a conventional sail, proper camber of the sail is usually lost, since the edge is partially unsupported. The uncambered edge has a much lower lift coefficient resulting in a significant loss in lift. Additionally the leakage flow under the foot edge tends to exacerbate the efficiency loss by reducing the pressure at the lower edge of the sail.

At the head, the situation is particularly aggravated in the case of a sailboard by the sharp rake angle of the mast tending to produce an early stall condition by spanwise air flow over the edge.

Prior attempts to control the sail shape in these regions have typically included rigid members, adding weight and increasing complexity due to the need to accommodate sail reversals in coming about.

So called "boom shelves" have been devised to provide a shaping piece along the boom. The shelf and sail foot are entirely dependent on the boom for both lateral and vertical support. In a sailboard, the boom is not located adjacent the foot edge, so that such arrangement could not be used for such craft. Also, the boom shelf design would not be applicable to the head area of the sail.

SUMMARY OF THE INVENTION

The present invention comprises an arrangement for establishing a self supporting camber shape at a horizontal edge of a sail, which does not depend on the boom as a structural part, and which may be used at the foot edge or at a horizontal edge at the head of the sail.

The arrangement involves the addition of a web of flexible material of a length corresponding to the sail edge, and having a curved perimeter on one side shaped in the desired camber, with the opposite side extending straight across the ends of the curved side to form a chord. The curved side is sewn or otherwise attached along the sail edge with the web disposed normally to the sail. A diagonally extending batten urges the tip of the sail edge and web outwardly to place the web in tension, which tension conforms the shape of the attached sail edge to the camber of the curved edge of the web.

In the application of the arrangement to the foot edge, the sail extends to the hull or board deck so that the web creates a dam greatly reducing air leakage flow around the foot edge. A skirt batten is also employed installed along the foot edge of the sail, anchored against the mast and extending to the web tip. Also, an additional one or more diagonal battens may be employed extending from the mast to intermediate points along the skirt batten.

At the head, because of the short chordal length a skirt batten may not be necessary, although at high wind speeds, such batten would aid in achieving the effect of the basic arrangement. Also, at the head an increased camber, i.e., 12% may be established to reduce the stalling tendency caused by the sharp rake angle.

At both the head and the foot, tension cords may be employed along the chordal edge to assist in installing and compressively loading the skirt battens.

This arrangement insures a well defined and controlled camber shape at a horizontal sail edge without the need for rigid shaping pieces and which accommodates the reversal of the sail in coming about.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
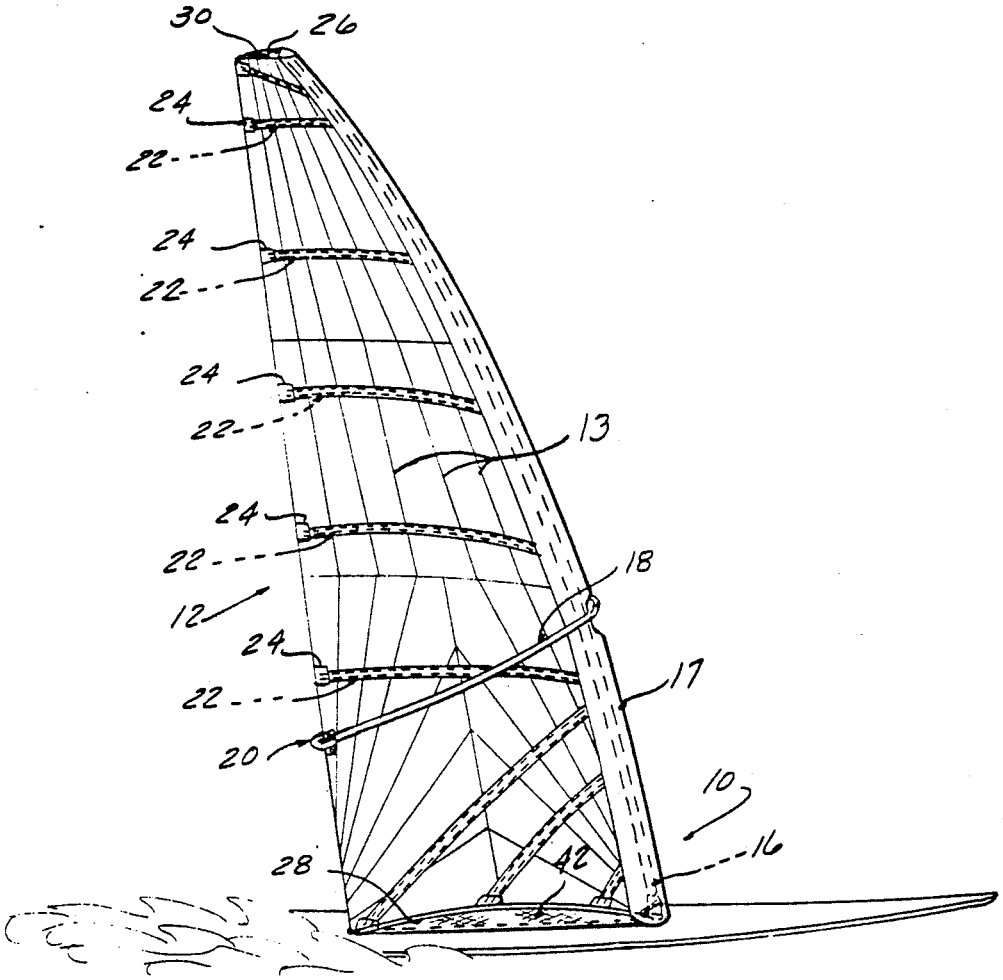
FIG. 1 is a side perspective view of a sailboard sailing craft incorporating the sail shaping arrangement according to the present invention at the head and foot edges of the sail.

Referring to FIG. 1, a sailing craft 10 is shown having a sail 12 incorporating the sail shaping arrangement according to the present invention. The sailing craft 10 is shown as a sailboard or windsurfer, having a platform hull or board 14 on which an upwardly extending mast 16 is pivotally supported. A rider controls the craft while standing on the board 14 and grasping a wishbone shaped boom 18. The boom 18 is attached to the leech of the sail 12 at the clew 20 and, at an intermediate height, to the mast 16.

The wishbone shaped boom 18 surrounds the sail 12 and enables the rider to hold on and control the sail tack in the manner well known to those skilled in the art.

The sail 12 may be generally of conventional construction, broad seamed to give the airfoil shape required, by sewing together a number of panels consisting of segments of conic sections along seams 13. A series of fore and aft extending battens 22 are anchored against the mast 16 and received in sail pockets 24 so as to be bent and assist the sail 12 in assuming a filled out curved shape, also in the manner well known to those skilled in the art.

The mast 16 can be secured within an outer sleeve 17 formed on the sail 12, and a design incorporating profile pieces within an outer sleeve 17, as described in U.S. Pat. No. 4,593,638 granted to the present inventors, can be employed, although the present invention can be used with or without this feature. In that arrangement an inner sleeve 17A is received over the mast 16, and foam plastic pieces (not shown) are compressed within the outer sleeve 17 and expand to form an aerodynamic profile.

According to one aspect of the present invention, the head of the sail 12 is slightly truncated at the tip of the mast 16 to create a generally horizontally extending upper edge 26. The foot of the sail 12 has a generally horizontally extending lower edge 28 closely adjacent the board 14.

Figure 3:
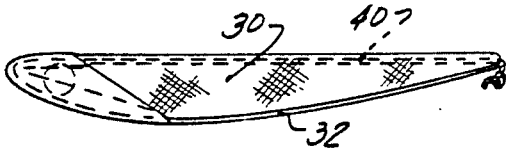
FIG. 3 is an enlarged, reverse plan view of the web incorporated in the sail shaping arrangement shown in FIG. 2.
Figure 3A:
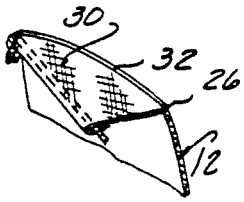
FIG. 3A is a fragmentary view of the section A—A taken in FIG. 3.
Figure 2:
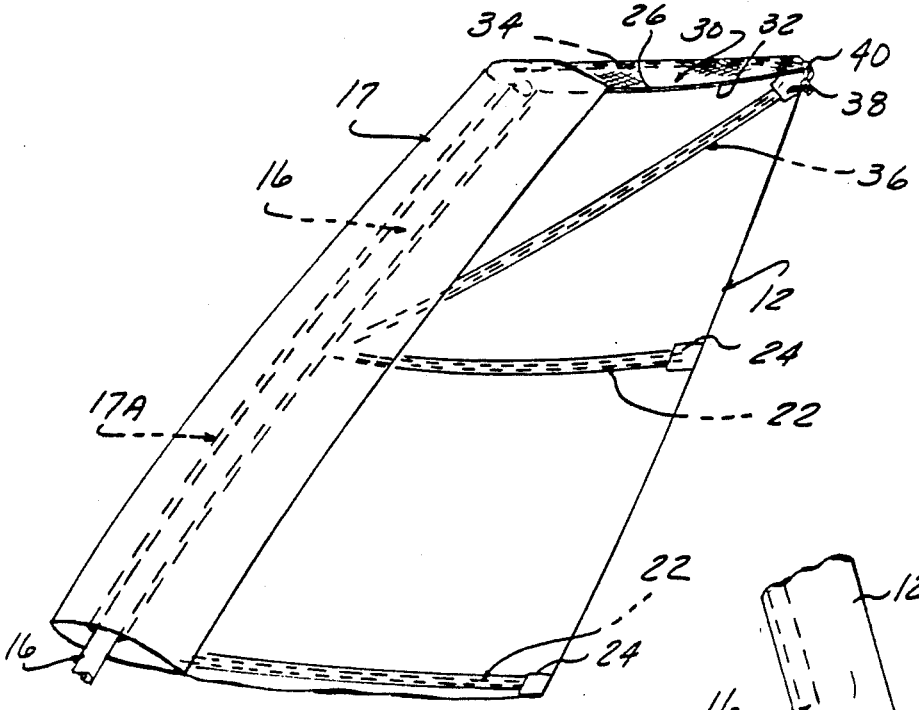
FIG. 2 is a fragmentary enlarged perspective view of the head portions of the mast and sail of the sailboard shown in FIG. 1, showing the details of the sail shaping arrangement at the head of the sail.

Referring to FIGS. 2 and 3, the details of the sail shaping arrangement according to the present invention as applied to an upper or head edge 26 of the sail 12 are shown. This arrangement includes a panel of flexible material such as dacron sail material shaped into a web 30. The web 30 is of a length corresponding to the width of the edge 26 of the sail 12 to be shaped, and has one side 32 cut to a curve in the shape of the desired airfoil of the sail at the edge 26. Typical sail design would have a 10% camber, although it may be advantageous to increase the camber at the head to counter the effects of the raked mast, i.e., a camber of 12%.

The other side 34 of the web 30 extends as a chord across the airfoil side 32. The web sides 32, 34 converge at the leading and trailing ends of the web 30.

The airfoil side 32 is attached to the edge 26 of the sail 12, as by sewing, so as to extend normally from the sail, to lie in a generally horizontal plane. The leading end of the web 30 is attached across the upper end of the sleeve 17, bisecting the mast 16. The trailing end of the web 30 is biased outwardly by a diagonal batten 36, housing one end engaging the mast 16 at a point below the edge 26, the other end received in a pocket 38 at the trailing end of the web 30. This arrangement draws the web 30 taut and effectively shapes the sail edge 26 to conform to the airfoil shape of the web side 32.

The web 30 is of a material able to resist tension without undue stretching, and reinforcement is not theoretically necessary. However, an adjustable length tension cord 40 extending in a seam along the chordal side 34 and attached at either end has been found to improve rigidity and make it much easier to insert the battens.

Figure 5:
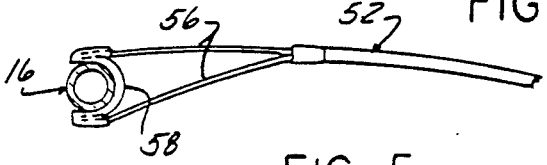
FIG. 5 is a plan view of the skirt batten incorporated in the foot edge sail shaping arrangement shown in FIG. 4.
Figure 4:
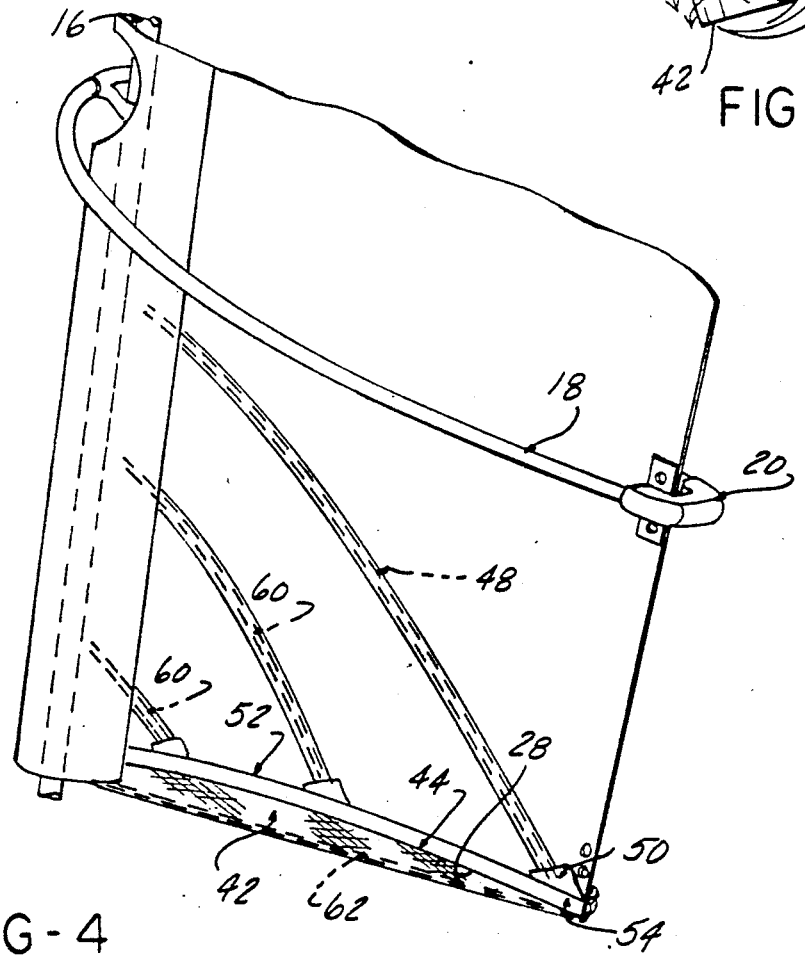
FIG. 4 is an enlarged fragmentary perspective view of the foot portion of the mast and sail of the sailboard shown in FIG. 1, showing the details of the sail shaping arrangement at the foot of the sail.
Figure 6:
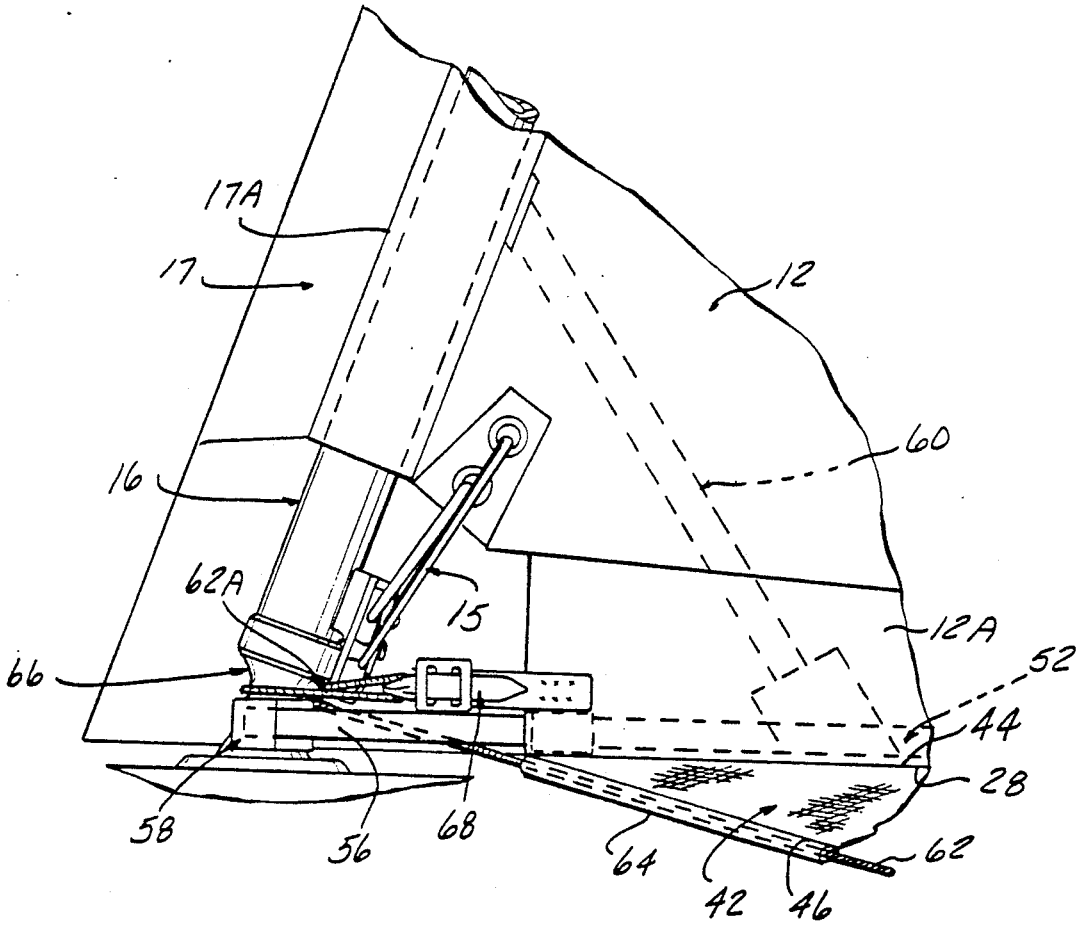
FIG. 6 is an enlarged fragmentary view of the tack area showing the details thereof.

Referring to FIGS. 4–6, the application of the sail shaping arrangement of the present invention to the foot edge 28 of the sail 12 is illustrated.

A web 42 is provided, of a length corresponding to the width of the sail 12 at the foot edge 28. The web 42 is cut along one side 44 in a curved shape corresponding to the desired camber of foot edge 28 of the sail 12. The opposite side 46 extends straight across chordally. The web 42 is attached as by sewing to the sail foot edge 28 so as to extend normally thereto, lying in a generally horizontal plane. A first diagonal batten 48 extends from the mast 16 at a point above the edge 28 downwardly to the trailing tip of the web 42, received in a pocket 50 so as to be bent and apply tension to the web 42.

A skirt batten 52 must also be employed for the foot edge 28, extending along the sail edge 28 to engage the mast at one end and received in a pocket 54 at the trailing end of the web 42. The skirt batten 52 is split at the leading end to have a pair of ends 56, engaging pockets in a belting piece 58 pressed against the mast 16. The split end design enables clearance with the downhaul rigging 15 at the mast 16.

One or more additional diagonal battens 60 may be used, stabilizing the skirt batten 52 along its length, such skirt batten may also be employed at the head in high winds.

FIG. 6 shows the arrangement of the present invention with the construction according to U.S. Pat. No. 4,593,638, in which an inner sleeve 17A is received over the mast 16.

A tension cord 62 may also be employed received in a hem 64 extending along the straight edge of the web 42. The tension cord 62 passes around the mast 16 at one end, at the mast base and universal 66, and is tied off at the outer end to make it easier to insert the battens 52, 60 and improve rigidity, as at the head.

A tension cord buckle 68 sewn to the sail edge and secured to the other end of the tension cord 62A passing around the universal joint 17 may also be provided to facilitate installation of the tension cord 62.

A heavier weight (8 oz) 56 border panel 12A sewn to the sail 12 has been found to assist in stablizing the edge shape at the foot.

Figure 7:
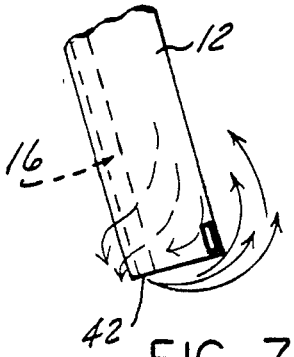
FIG. 7 is a diagrammatic endwise view of the foot edge of the sail with the web, showing the leakage flow impeding effect of the web.

As shown in FIG. 7, the presence of the web 42 creates a dam effect impeding air flow past the edge 28 to greatly improve the performance of the sail.

The arrangement according to the present invention has been found to create a fairly stiff defined edge at the head and foot edges of the sail, which reverses to accommodate the reversals in tack of the sail 12 when coming about.

The arrangement is lightweight and simple to provide much improved sail performance at low cost and without a significant weight penalty.

While particularly advantageous in the context of a sailboard, the arrangement is applicable to other sailing craft.

What is claimed is:

1. In a sailing craft of the type including a hull, an upwardly extending mast attached to the hull of the craft and a sail of flexible sheet material having generally vertical forward and rear edges and a least one horizontal edge connecting said forward and rear edges, said sail attached along said forward edge to the mast and extending from the mast to said rear edge, said rear edge attached at a clew to a boom, said sail at least one horizontal edge having a camber shape, the improvement of a sail shaping arrangement for said generally horizontal edge of said sail, said arrangement comprising a web having opposite sides converging together at a leading and at a trailing end of said web, one side of said web shaped in an airfoil shape matched to the camber of said horizontal edge of said sail and extending from the forward to the rear edge of said sail with the trailing end of said web located at the rear edge of said sail, the opposite side of said web extending from said leading end to the trailing end of said web in a chord across said airfoil shape, said shaped one side of said web attached along the horizontal edge of said sail to extend said web normally to said sail in a generally horizontal plane; a skirt batten extending along said shaped one side of said web and said horizontal edge of said sail, and, a diagonally extending batten extending across said sail from said forward edge at said mast to the trailing end of said web, whereby the horizontal edge of said sail is supported in said airfoil shape.

2. The sailing craft according to claim 1 wherein said sail is formed with a pair of generally horizontal edges at the head and foot of said sail respectively and wherein said sail shaping arrangement is provided at both said head and said foot edge of said sail.

3. The sailing craft according to claim 1, said arrangement further including a tension cord extending along said opposite side of said web, from said leading end of said web and tied off at the trailing end of said web.

4. A sailboard craft of the type including a board, an upwardly extending mast pivotally attached to said board, a wishbone shaped boom mounted at an intermediate height on said mast, a sail of a sheet of flexible sheet material, said sail having a leading edge secured to said mast, said sail lying within said boom and extending to a rear edge having a point of attachment at a clew, said sail having an upper head edge and a lower foot edge, each head and foot edge having a camber shape, a sail shaping arrangement for defining the shape of said sail along said head and foot edges, said arrangement including a web for each of said head and foot edges, said web having opposite sides converging at leading and trailing ends of said web, one of said sides shaped in a curved air foil and the other side shaped as a straight connecting chord extending between said leading and trailing ends of said web, each web one side air foil shape matched to the camber shape of the respective head and foot edge of said sail and extending from the forward to the rear edge of said sail with the trailing end of said webs each located at the rear edge of said sail; each of said webs attached along said curved airfoil one side to a respective head and foot edge of said sail so as to extend said webs normally to said sail, whereby the definition of the camber shape of said head and foot edges is assisted by the attachment of said webs thereto.

5. The sailboard according to claim 4 wherein said sail shaping arrangement further includes a skirt batten extending along the foot edge of said sail from said mast to the trailing end of said web.

6. The sailboard according to claim 5 further including at least one diagonal batten extending within said sail from a point along said mast above said foot edge to said tip of said airfoil shape at said foot edge of said sail.

7. The sailboard according to claim 5 wherein said sail shaping arrangement comprises a pair of skirt battens, one each extending within said sail along said head and foot edges respectively from the forward to the rear edges of said sail.

8. The sailboard according to claim 7 wherein said sail shaping arrangement further includes a pair of tension cords, one attached to the mast at the head and another at the foot, each extending across said chordal other side of said web, tied off at the rear edge of said sail.

9. The sailboard according to claim 8 further including at least one diagonal batten at the head and at the foot edge of said sail, each diagonal batten extending from the mast to the head or foot edge of said sail at an acute angle to said mast.

10. The sailboard according to claim 4 wherein said foot edge of said sail is closely adjacent the board, whereby said web at said foot edge impedes leakage air flow past said foot edge and across said board.

* * * * *